United States Patent [19]

Ikari et al.

[11] Patent Number: 4,869,075

[45] Date of Patent: Sep. 26, 1989

[54] AIR CONDITIONER

[75] Inventors: Yoshiki Ikari, Ashikaga; Tadashi Hori; Fujio Suzuki, both of Ota; Shyozi Tsunekawa, Nitta; Wazoh Yamada, Gunma; Hideo Maeda, Ashikaga, all of Japan

[73] Assignee: Sanyo Electric Co., Ltd., Osaka, Japan

[21] Appl. No.: 268,972

[22] Filed: Nov. 9, 1988

[30] Foreign Application Priority Data

Nov. 16, 1987 [JP] Japan ..... 62-288797
Nov. 16, 1987 [JP] Japan ..... 62-288798

[51] Int. Cl.[4] ..... F25B 47/00

[52] U.S. Cl. ..... 62/280; 62/262; 62/305; 62/324.1

[58] Field of Search ..... 62/150, 279, 280, 305, 62/91, 324.1, 262; 261/29

[56] References Cited

U.S. PATENT DOCUMENTS 2,982,110 5/1961 Kramer ..... 62/280
3,570,822 3/1971 Peterson et al. ..... 261/29
4,004,432 1/1977 Kong et al. ..... 62/262
4,136,529 1/1979 McCarty ..... 62/280
4,378,679 4/1983 Stocking et al. ..... 62/280

FOREIGN PATENT DOCUMENTS 48-29715 9/1973 Japan .

*Primary Examiner*—Lloyd L. King
*Attorney, Agent, or Firm*—Wenderoth, Lind & Ponack

[57] ABSTRACT

An air conditioner comprises a water distributor having an opening on its bottom plate, dams around the opening and inverted U-shaped members with a small space formed between the inverted U-shaped plates and the dams so that water in the distributor is guided by a capillary action and distributed to an indoor heat exchanger. A reservoir is disposed to a pipe system between a pump and the indoor heat exchanger so that drain water in the outdoor drain pan is directed to the indoor heat exchanger through the reservoir. The reservoir has a tube which permits excessive water to spill over an opening of the tube to return to the outdoor drain pan through a returning conduit pipe.

5 Claims, 5 Drawing Sheets

AIR CONDITIONER

BACKGROUND OF THE INVENTION

The present invention relates to an air conditioner which permits to distributes drain water onto an indoor heat exchanger to humidify the air in a room, wherein the drain water was generated by an outdoor heat exchanger at the time of a heating operation.

The air conditioner of the type described above is shown in, for example, Japanese Utility Model Publication No. 48-29715 published Sept. 10, 1973. The conventional air conditioner disclosed in the Japanese publication directs drain water generated by an outdoor heat exchanger to a water distribution pan, which is disposed on top of an indoor heat exchanger, through conduit pipe to produce heat by the indoor heat exchanger. The drain water heated by the indoor heat exchanger is evaporated to flow into a room. The water distribution pan has a water absorption material therein so that the water is distributed evenly and efficiently to the entire portion of the water distributor pan. However, if the drain water contains a dust or other foreign particles, a water distribution function of the pan is deteriolated. Further, the conduit pipe has a control valve for controlling a flow rate of the drain water in the pipe to thereby control the flow of drain water to the indoor heat exchanger.

U.S. Pat. No. 3,570,822 discloses a humidifier having a water distribution pan for providing a flow of water to a saturated water pad. The water distribution pan includes a number of apertures in the bottom with a channel leading from each aperture to a reservoir at one end of the pan. The reservoir is defined by sidewalls of the pan and a dam in the pan between the sidewalls so that water spills over the dam and flows through the channels and drains out through the apertures.

However, in the U.S. Pat. No. 3,570,822 water does not always spill over immediately when the level of water becomes higher than the height of the dam due to a surface tension of water and, accordingly, it is rather difficult to proceed a humidifying operation immediately. Further, if the water distribution pan is more or less declined, water flows from the declined lowest portion, resulting in a failure in providing an even distribution of water.

SUMMARY OF THE INVENTION

An object of the present invention is to provide an improvement which provides an even distribution of water to heat exchanger for humidifying purposes.

Another object of the present invention is to provide an improvement which can provide an immediate distrubution of water collected in a water distribution pan to a heat exchanger.

A further object of the present invention is to provide an improvement which can collect water other than that necessary for humidifying and feed the collected, unnecessary water without fail to an outdoor drain pan to thereby prevent possible damage by water to electrical parts and elements in the air conditioner.

According to an embodiment of the present invention, the air conditioner has a water distribution pan comprising an opening on a bottom plate thereof, dams around the opening, and inverted U-shaped plates disposed with a small space formed between the U-shaped plates and the dam so that the water is guided by a capillary action in the small space and then distributed to an indoor heat exchanger.

In the air conditioner described above, drain water in the water distribution pan is immediately fed through the small space between each of the inverted U-shaped plates and the dam so that water is distributed in the form of droplets to the indoor heat exchanger.

According to another embodiment of the present invention, a reservoir is provided to a couduit pipe extending from an outdoor drain pan to an indoor heat exchanger by way of the reservoir so that drain water in an outdoor drain pan is directed to the indoor heat exchanger through the reservoir, and the reservoir has therein a tube which permits water to spill over to return to the outdoor drain pan through a returning conduit pipe.

In the latter embodiment described above, water collected in the outdoor drain pan is provisionally stored in the reservoir, and when the water level of the water is lower than the height of a top opening of the tube, all the stored water is directed to the indoor heat exchanger. On the other hand, when the level becomes higher than the tube, water overflows or spills over the top opening of the tube and then the unnecessary water is flown to the outdoor drain pan through the returning conduit pipe.

REFERRED EMBODIMENTS OF THE INVENTION

Figure 1:
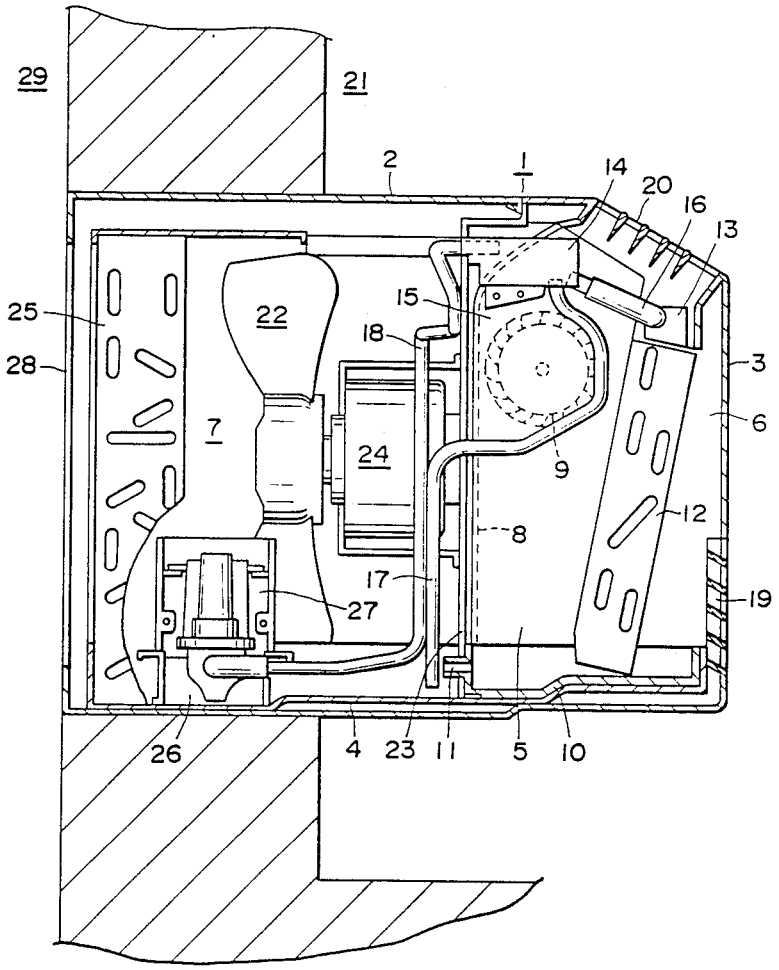
FIG. 1 is a sectional view of an air conditioner embodying the present invention.

Referring first to FIG. 1, a housing 1 of an air conditoner has an outer casing 2 and a decorative casing 3. A base plate 4 is slidably mounted on a bottom of the outer casing 2. A casing 5 is disposed on the base plate 4 and has a partition wall 8 for defining, in the outer casing 2, an indoor chamber 6 and an outdoor chamber 7. A cross-flow fan 9 is disposed in the casing 5.

The indoor chamber 6 has an indoor drain pan 10 on the base plate 4 which connects a discharge port 11 with the outdoor chamber 7, and an indoor heat exchanger 12 on the indoor drain pan 10 at a front portion of the casing 5. The heat exchanger 12 functions as a evaporator at a cooling operation and as a condenser at a heating operation. A drip tray or water distribution pan 13 is placed on the indoor heat exchanger 12 and a reservoir 14 is fixed to a side portion 15 of the casing 5 at the position higher than the position of the water distribution pan 13. The reservoir 14 is connected with the water distribution pan 13 through a first conduit pipe 16, and the outdoor chamber 7 through a second conduit pipe 18 and through a returning conduit pipe 17.

Thus, when the cross-flow fan 9 is driven, air of the room to be air-conditioned is sucked from an inlet 19 of the decorative casing 3 and then heated or otherwise cooled by the indoor heat exchanger 12. Then, the heated or cooled air is discharged into an interior of the room 21 from an outlet 20 of the decorative casing 3.

The outdoor chamber 7 has a propeller fan 22, an electric motor 24 for driving the propeller fan 22 and supported by supporting legs 23 on the base plate 4, an outdoor heat exchanger 25 which functions as a condenser in a cooling operation and as an evaporator in a heating operation, and an outdoor drain pan 26 which has a partly depressed bottom and functions. The outdoor drain pan 26 functions in a cooling operation to collect drain water which is generated by the indoor heat exchanger 12 in a cooling operation and flown from the discharge port 11 of the outdoor drain pan 26 to the outdoor chamber 7, and in a heating operation, to collect drain water which is generated by the outdoor heat exchange 25. The reservoir 14 is connected to a drain pump 27 by means of a second conduit pipe 18, the drain pump 27 being described presently.

Thus, when the propeller-fan 22 is driven, an outdoor air is sucked from suction ports (not shown) which are disposed on both sides of the outdoor heat exchanger 25 and cooled or otherwise heated by an outdoor heat exchanger 25, and then discharged to the outdoor heat exchanger 25, and then discharged to the outdoor 29 through a discharge port 28.

Figure 2:
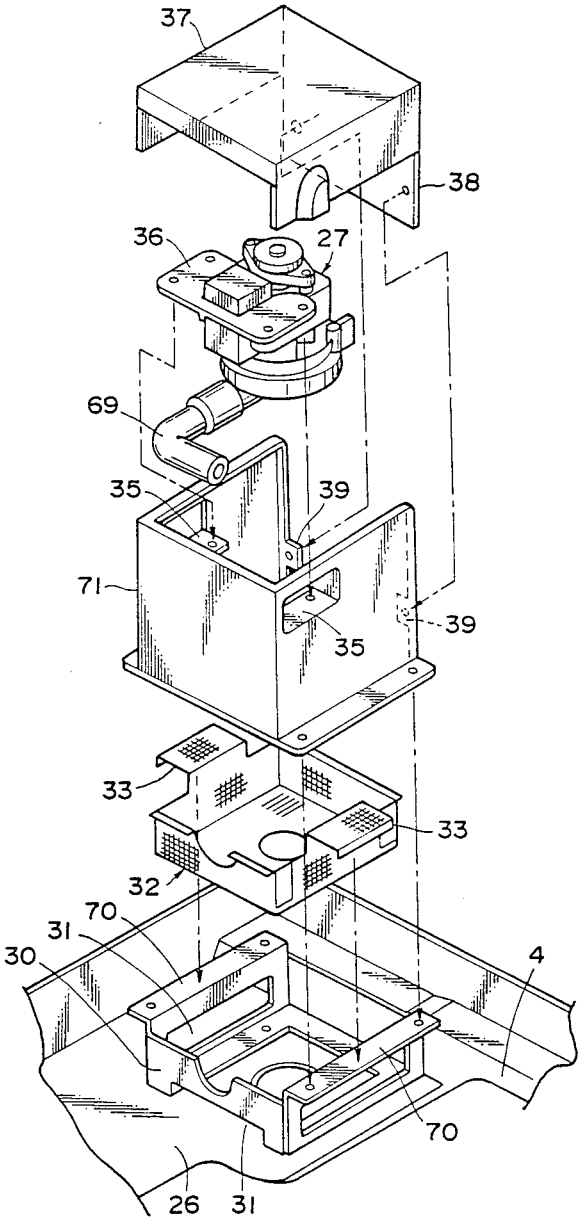
FIG. 2 is a fragmentary perspective view showing a manner how a drain pump is assembled to an outdoor drain pan on a bottom plate of the outdoor drain pan.
Figure 7:
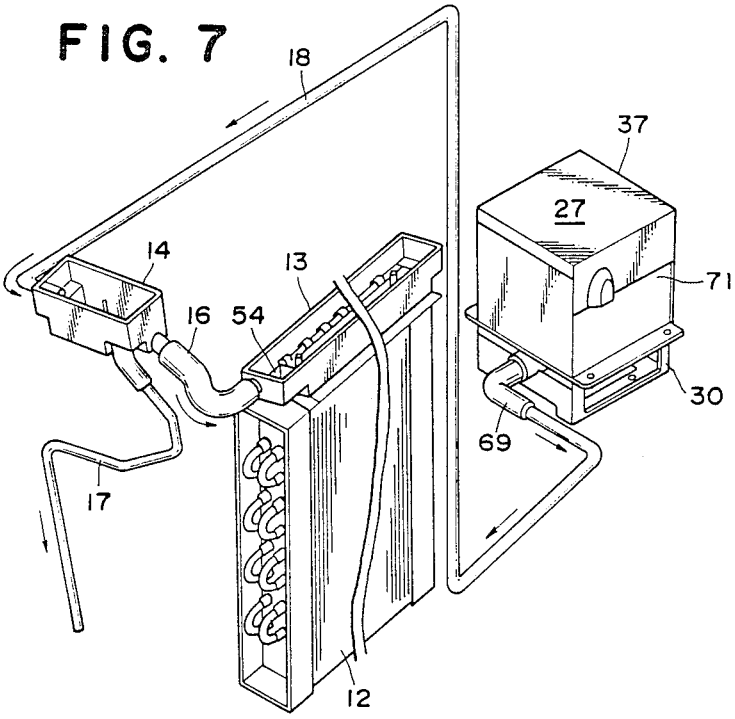
FIG. 7 is a diagram illustrating a drain water flowing system.

In FIG. 2, the drain pump 27 is shown to be installed in the outdoor drain pan 26. A base 30 is fixed on the outdoor drain pan 26 and has water passages 31 at its four sides, opposing bent portions 70 and a first filter 32 snugly fitted to the inner surface so that bent portions 33 extending in opposite directions are snugly fitted to the bent portions 70 of the base 30. A lower cover 71 is fixed to the bent portions 70 of the base 30 and has front tabs 39 and side tabs 35 extending inwardly for fixing the drain pump 27 through a flange 36. An upper cover 37 has a front plate 38 for fixing with the lower cover 71 through the front tabs 39. Thus, the drain pump 27 is housed by the two covers 37, 71 as illustrated in FIG. 7.

Figure 3:
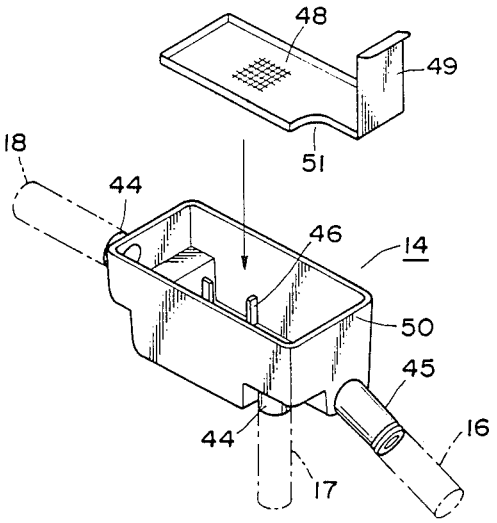
FIG. 3 is a perspective view of a reservoir in the air conditioner shown in FIG. 1.
Figure 4:
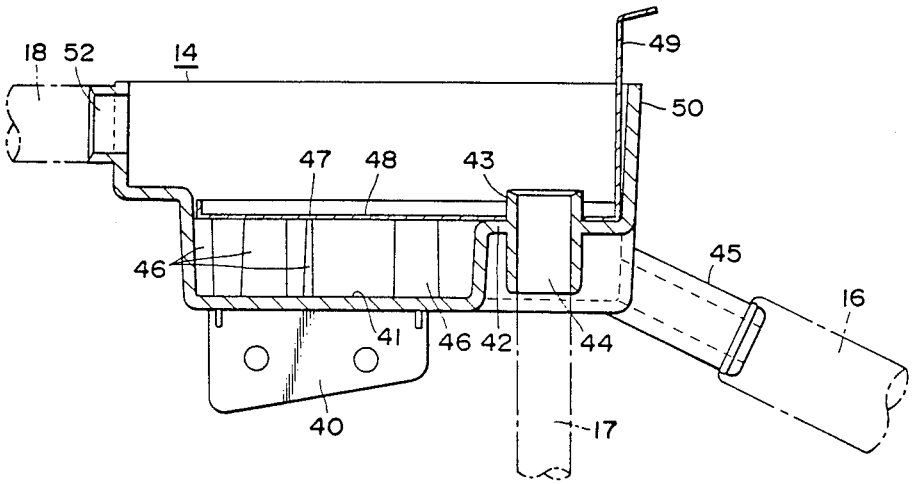
FIG. 4 is a sectional view of the reservoir shown in FIG. 3.

With reference to FIGS. 3 and 4, the reservoir 14 has a fixing member 40 and is fixed to a side of the casing 5 (FIG. 1). The reservoir 14 has a raised portion 42 on the bottom and a tube 43 projecting above the level of the raised portion and having a lower opening 44. The lower opening 44 of the tube 43 is connected with the returning conduit pipe 17. The reservoir 14 has opening 52 connected with the second conduit pipe 18, and a connector tube 45 connected with the first conduit pipe 16. Supporting legs 46 extend upright from the bottom 41 the level of the raised surface 42 to support a second filter 48. The second filter 48 has a mesh size smaller than that of the first filter 32 and is supported on the supporting legs 46 and the raised portion 42. The second filter 48 has a grip 49 which extends upward above an upper end of a side wall 50 of the reservoir 14 for facilitating a removal operation of the filter 48 from the reservoir 14, and a cut-out portion 51 at a corner so as to meet the contour of the tube 43.

In the reservoir 14 explained above, drain water collected in the drain pan 26 (FIG. 1) of the outdoor chamber 7 s fed through the second conduit pipe 18 and filtered by the second filter 48 to remove a dust or other foreign particles, and then delivered to the connector tube 45. In a heating operation, if an outdoor humidity is high and an amount of drain water generated by the outdoor heat exchanger 25 is increased with the result that the amount of the drain water is larger than that of the discharged water from the first conduit pipe 16, a water level in the drain reservoir 14 is gradually elevated upward until it arrives at the level of an upper end of the tube 43. When the water level is higher than the upper opening of the tube 43, water overflows into the tube 43 and flows down through the lower opening 44 of the tube 43 and the returning conduit pipe 17 to the base plate 4 of the outdoor chamber 7. Thus, an amount of water directed to the water distribution pan 13 is maintained constant and excessive water is not directed to the water distribution pan 13.

Figure 5:
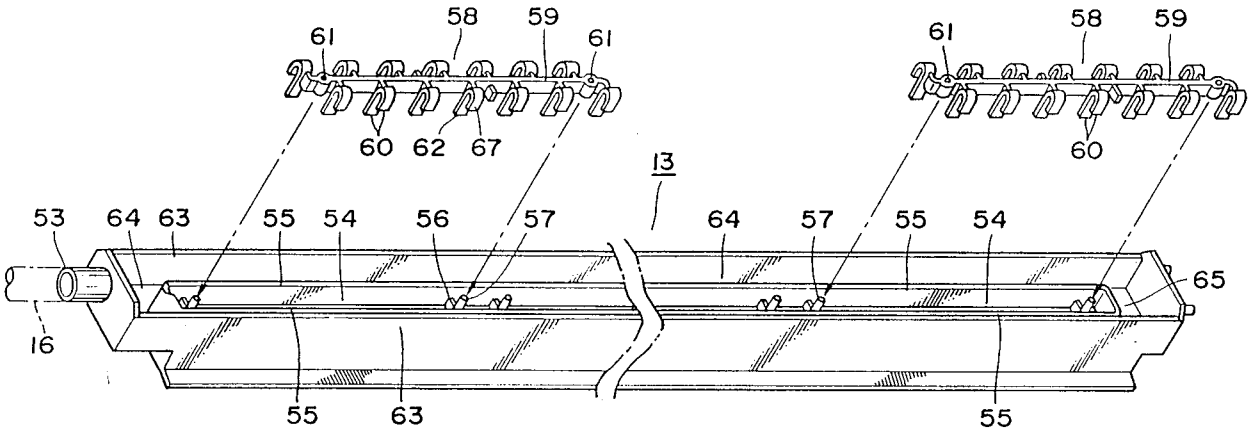
FIG. 5 is a fragmentary perspective view of a water distribution pan of the air condition shown in FIG. 1.
Figure 6:
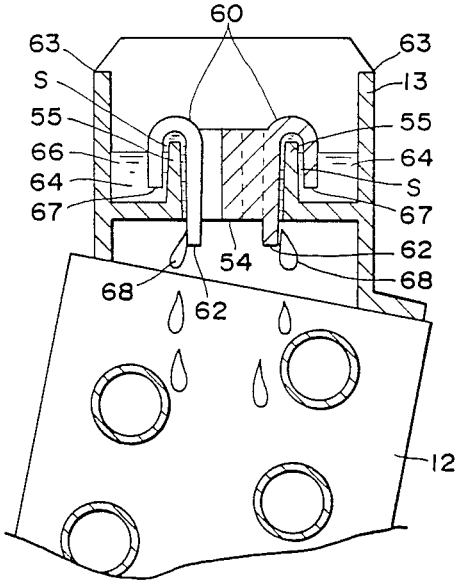
FIG. 6 is a sectional view of the water distribution pan shown in FIG. 5.

With reference to FIGS. 5 and 6, the water distribution pan or a drip tray, which will be referred to as "distributor 13", has an inlet tube 53 connected with the first conduit pipe 16 (FIG. 1). The distributor 13 has a plurality of openings or slots 54 on the base along the length thereof, and dams 55 raised above the level of the opening 54 to enclose the opening 54. The dams 55 are connected together by ten ribs 56 (six ribs being shown) each of which has an engagement pin 57. Five water passage members 58 (two members being shown for simplification) positioned in the longitudinal opening 54, each of which has a longitudinal connecting bar 59, inverted U-shaped members 60 arranged in a staggered relation on the opposite sides of the bar 59, and holes 61 at the ends of the bar 59 for fixture to the engagement pins 57. Each of the water passage members 58 has fourteen inverted U-shaped members 60. Thus, the water passage members 58 are assembled and fixed to the engagement pins 57 to form the distributor as illustrated in cross section in FIG. 6. In the assembled construction, a space in the range of 0.3 mm–1.0 mm is formed between the inverted U-shaped member 60 and the dam 55, and each of the inverted U-shaped members has a longer portion 62 extending downward beyond the longitudinal opening 54, and a shorter portion 67, and thus the water distributor includes seventy downwardly extending longer portions 62.

In the distributor 13 mentioned above, when drain water is fed into the distributor 13 from the inlet tube 53, the drain water is delivered along water passages 64 which is formed by the combination of the dam 55 and a bank 63 and join to flow at an end portion 65 opposite to the inlet tube 53. When the water passage 64 is filled with drain water 66, water level of the water 60 becomes higher than the shorter portions 67 of the inverted U-shaped members 60, as illustrated in FIG. 6. Then water is delivered through the space S between the inverted U-shaped member 60 and the dam 55 by a capillary action produced in the space S. The water is then subjected to dropping from the longer portion 62 of the inverted U-shaped member 60 to the indoor heat exchanger 12 in the form of droplet. Since the water is delivered through very small space S or a gap between the surface of the inverted U-shaped member and a longitudinal surface of the dam 55, water will be delivered through most of the spaces S even though some of the spaces S are choked by a dust or other foreign particles contained in the drain water. Thus, necessary water dropping is ascertained by numbers of spaces S.

As mentioned above, the distributor 13 in the illustrated embodiment has seventy inverted U-shaped members 60, which means that seventy droplets are dropped at a time onto the indoor heat exchanger 12. Accordingly, when the dust or other foreign particles produce choking in some of the small spaces S, an even distribution of water is maintained by the other spaces. Further, even though dropping supply of water to the distributor 13 is stopped by some reasons, the dropping supply of water of the distributor 13 by a capillary action onto the indoor heat exchanger 12 is maintained as long as the water level in the distributor 13 is higher than the shorter portion 67 of the inverted U-shaped member 60. As illustrated in FIG. 6, the shorter portion 67 of the inverted U-shaped member 60 is extended deeply toward, and immediately above, the bed of the water passage 64, and the drain water in the distributor 13 is almost completely used for droplet distribution, with a minimum amount of water left in the distributor 13.

Referring to FIGS. 1 and 7, drain water produced by the outdoor heat exchanger 25 is sucked by the drain pump 27 and directed to the reservoir 14 through the discharge port 69 and the second conduit pipe 18 as shown by arrows in FIG. 7. When the water level in the reservoir 14 becomes higher than the predetermined level, that is, an upper end of the tube 43 (FIG. 4), water spills over the tube 43 to be directed back to the outdoor drain pan 26 through the returning conduit pipe 17. On the other hand, drain water in the reservoir 14 is directed to the distributor 13 through the first conduit pipe 16 and supplied from the inverted U-shaped member 60 in the longitudinal opening 54 of the distributor 13 to the indoor heat exchanger 12 in the form of a droplet. When the dust or other foreign particles are included in drain water collected in the outdoor drain pan 26 of the outdoor chamber 7, the dust or other foreign particles are removed by the first filter 32 to prevent any obstruction to an operation of the drain pump 27. If there still exist minute dust or other foreign particles after filtration by the first filter 32, such a dust or other foreign particles will be removed by the second filter 48 (FIG. 4) of the reservoir 14. Thus, drain water discharged by the drain pump 27 is directed to the distributor 13 with less dust or other foreign particles included therein.

Preferably, the second conduit pipe 18 is connected with the drain pump 27 in such a manner that it extends downward toward the drain pump 27 so that no water is left at any part of the second conduit pipe 18 when the drain pump 27 is stopped by some reasons, to thereby prevent any crack or damage of the second conduit pipe 18 due to freezing of water in winter.

In a cooling operation of the air conditioner, the operation of the drain pump 27 is stopped to receive the drain water, which is generated by the indoor heat exchanger 12, in the drain pan 10 of the indoor chamber 6. Then, the drain water is collected by the outdoor drain pan 26 and splashed to the outdoor heat exchanger 25 by means of a suitable splash device (not shown).

According to the present invention, a number of spaces formed between the inverted U-shaped members and the dams can provide an even and smooth distribution of water to the heat exchanger without any delay and obstruction due to dust or other foreign particles in water. Further, the returning conduit pipe 17 permits excessive supply of water to be returned to the outdoor drain pipe 26 of the outdoor chamber 7 for a successive use.

While the invention has been described in the specification and illustrated in the drawings with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention will not be limited to the particular embodiment illustrated by the drawings contemplated for carrying out the present embodiments falling within the description of the appended claims.

What is claimed is:

1. An air conditioner comprising:

a housing having therein a partition wall to confine an outdoor chamber and an indoor chamber within said housing, an outdoor heat exchanger in said outdoor chamber, an outdoor drain pan, disposed in said outdoor chamber, for receiving drain water dropped from said outdoor heat exchanger, an indoor heat exchanger in said indoor chamber, water distribution means, disposed onto said indoor exchanger for distributing drain water to said heat exchanger, a pump device, connected with said water distribution means, for directing said drain water collected in said outdoor drain pan through a conduit pipe to said water distribution means in a heating operation, wherein said water distribution means has dams and banks to provide water passages, and inverted U-shaped members arranged in a predetermined relation with each other and mounted with a space being formed relative to said dams so that the drain water in said water passage is guided outside dams through said space by a capillary action and distributed to said indoor heat exchanger.

2. An air conditioner according to claim 1, wherein said inverted U-shaped members are fixed to an elongated fixing member along the length thereof in a staggered relation with each other on opposite sides of said fixing member.

3. An air conditioner according to claim 1, wherein said water distribution means has a base and a plurality of slots on said base, and wherein said inverted U-shaped members are fixed to an elongated fixing member along the length thereof in a staggered configuration with each other on opposite sides of said fixing member to form a water passage member in said water distribution means.

4. An air conditioner according to claim 3, wherein fixing pins are disposed at said openings of said water distribution fixing said water passage member in position in said water distribution means.

5. An air conditioner comprising:

a housing having therein a partition wall to confine an outdoor chamber and an indoor chamber within said housing, an outdoor heat exchanger in said outdoor chamber, an outdoor drain pan, disposed in said outdoor chamber, for receiving drain water dropped from said outdoor heat exchanger, an indoor heat exchanger in said indoor chamber, a water distribution means, disposed onto said indoor heat exchanger, for distributing said drain water to said heat exchanger, reservoir means, connected to said water distribution means by a first conduit pipe, for preliminary storing a predetermined amount of a drain water, a pump device, connected to said reservoir means by a second conduit pipe, for directing drain water collected in said outdoor drain pan to said water distribution means, wherein said reservoir means has a tube projecting from the bottom thereof to a predetermined length in said reservoir means and a returning conduit pipe having one end connected to a lower end of said tube so that an excessive water in said reservoir means is directed through said pipe and returned to said outdoor drain pan.

* * * * *

UNITED STATES PATENT AND TRADEMARK OFFICE
CERTIFICATE OF CORRECTION

PATENT NO. : 4,869,075

DATED : September 26, 1989

INVENTOR(S) : IRAKI et al.

It is certified that error appears in the above-identified patent and that said Letters Patent is hereby corrected as shown below:

Column 1, line 6, for "to distributes", read --distribution of--;
line 17, for "produce heat", read --be heated--;
line 21, for "to", read --over--;
line 23, delete "a";
line 24, for "a", read --the--;
line 25, for "deteriolated", read --caused to deteriorate--;
line 42, delete "a";
line 45, for "declined" read --inclined--, for "from", read --to--, and delete "declined" in the second instance;
line 52, insert --a-- after "to";
line 55, for "trubution", read --tribution--;
line 65, for "on", read --in--;

Column 2, line 9, for "couduit", read --conduit--;
line 25, for "is flown", read --flows--;
line 31, delete "a";
line 32, delete "manner";
line 59, delete "a";
line 60, for "at", read --in-- in both instances;
line 63, for "the" in the second instance, read --a--;

Column 3, line 5, for "an", read --the--;

line 13, delete "and functions";

UNITED STATES PATENT AND TRADEMARK OFFICE

CERTIFICATE OF CORRECTION

PATENT NO. : 4,869,075

DATED : September 26, 1989

INVENTOR(S) : IKARI et al.

It is certified that error appears in the above-identified patent and that said Letters Patent is hereby corrected as shown below:

Column 3, line 16, for "flown", read --which flows--;
line 23, delete "an";
line 28, for "outdoor", read --outdoors--;
line 53, insert --to-- after "41";
line 65, delete "a";
line 67, for "an", read --the--;

Column 4, line 3, for "a", read --the--;
line 5, for "an", read --the--;
line 10, for "an", read --the--;
line 24, insert --are-- before "positioned";
line 41, for "mentioned", read --described--;
line 44, for "is", read --are--;
line 47, insert --the-- before "water level";
line 60, delete "a";
line 62, for "numbers", read --the number--;
line 63, for "mentioned", read --described--;
line 67, delete "the";

Column 5, line 2, delete "supply";

line 4, delete "supply";
line 21, for "an", read --the--;

UNITED STATES PATENT AND TRADEMARK OFFICE

CERTIFICATE OF CORRECTION

PATENT NO. : 4,869,075

DATED : September 26, 1989

INVENTOR(S) : IKARI et al.

It is certified that error appears in the above-identified patent and that said Letters Patent is hereby corrected as shown below:

Column 5, line 35, delete "a";

line 45, for "by", read --for" and for "reasons", read --reason--;

line 56, for "a", read --the--;

line 61, insert --the-- before "water";

line 62, delete "supply of";

Column 6, line 13, for "confine", read --define--;

line 21, for "onto", read --on--;

line 44, for "on", read --in--;

line 55, for "confine", read --define--;

line 63, for "onto" read --on--;

line 67, for "preliminary", read --preliminarily--;

Column 8, line 3, delete "an".

Signed and Sealed this

Twelfth Day of February, 1991

*Attest:*

HARRY F. MANBECK, JR.

*Attesting Officer*

*Commissioner of Patents and Trademarks*